US010158943B2

(12) United States Patent
Conklin et al.

(10) Patent No.: US 10,158,943 B2
(45) Date of Patent: Dec. 18, 2018

(54) APPARATUS AND METHOD TO BIAS MEMS MOTORS

(71) Applicant: Knowles Electronics, LLC, Itasca, IL (US)

(72) Inventors: Wade Conklin, Chicago, IL (US); Michael Kuntzman, Chicago, IL (US); Sung Bok Lee, Chicago, IL (US)

(73) Assignee: Knowles Electronics, LLC, Itasca, IL (US)

( * ) Notice: Subject to any disclaimer, the term of this patent is extended or adjusted under 35 U.S.C. 154(b) by 0 days.

(21) Appl. No.: 15/421,278

(22) Filed: Jan. 31, 2017

(65) Prior Publication Data

US 2017/0223455 A1 Aug. 3, 2017

Related U.S. Application Data

(60) Provisional application No. 62/289,611, filed on Feb. 1, 2016.

(51) Int. Cl.

| | |
|---|---|
| ***H04R 19/01*** | (2006.01) |
| ***H04R 3/04*** | (2006.01) |
| ***H04R 19/04*** | (2006.01) |
| ***H04R 1/24*** | (2006.01) |
| ***H04R 3/06*** | (2006.01) |
| *H04S 7/00* | (2006.01) |

(52) U.S. Cl.

CPC ..... *H04R 3/04* (2013.01); *H04R 1/245* (2013.01); *H04R 3/06* (2013.01); *H04R 19/04* (2013.01); *H04R 2201/003* (2013.01)

(58) Field of Classification Search

CPC ..... H04R 19/005; H04R 19/04; H04R 2201/003; H04R 3/005; H04R 19/016; H04R 1/222; H04R 1/406; H04R 1/04; H04R 1/326; H04R 2499/11; H04R 2499/15; H04R 31/00; H04R 3/00; B81B 2201/0257; B81B 2203/0127

USPC ..... 381/111, 113, 170, 355, 71.7, 98–99

See application file for complete search history.

(56) References Cited

U.S. PATENT DOCUMENTS

| | | | |
|---|---|---|---|
| 7,190,038 | B2 | 3/2007 | Dehe et al. |
| 7,473,572 | B2 | 1/2009 | Dehe et al. |
| 7,781,249 | B2 | 8/2010 | Laming et al. |
| 7,795,695 | B2 | 9/2010 | Weigold et al. |
| 7,825,484 | B2 | 11/2010 | Martin et al. |
| 7,829,961 | B2 | 11/2010 | Hsiao |
| 7,856,804 | B2 | 12/2010 | Laming et al. |
| 7,903,831 | B2 | 3/2011 | Song |

(Continued)

OTHER PUBLICATIONS

International Search Report and Written Opinion, PCT/US2017/015895, Knowles Electronics, LLC, 19 pages (dated Jun. 7, 2017).

*Primary Examiner* — Norman Yu

(74) *Attorney, Agent, or Firm* — Foley & Lardner LLP

(57) ABSTRACT

A microphone includes a first micro electro mechanical system (MEMS) motor, the first MEMS motor including a first diaphragm and a first back plate; and a second MEMS motor including a second diaphragm and a second back plate. The first diaphragm is electrically biased relative to the first back plate according to a first voltage, the second diaphragm is biased relative to the second back plate according to a second voltage, and a magnitude of the first voltage is different from a magnitude of the second voltage.

15 Claims, 6 Drawing Sheets

(56) References Cited

U.S. PATENT DOCUMENTS

| | | | | |
|---|---|---|---|---|
| 2005/0207605 | A1 | 9/2005 | Dehe et al. | |
| 2007/0278501 | A1 | 12/2007 | MacPherson et al. | |
| 2008/0152171 | A1 | 6/2008 | Hovesten et al. | |
| 2008/0175425 | A1 | 7/2008 | Roberts et al. | |
| 2008/0192962 | A1* | 8/2008 | Halteren | H04R 1/222 381/170 |
| 2008/0267431 | A1 | 10/2008 | Leidl et al. | |
| 2008/0279407 | A1 | 11/2008 | Pahl | |
| 2008/0283942 | A1 | 11/2008 | Huang et al. | |
| 2009/0001553 | A1 | 1/2009 | Pahl et al. | |
| 2009/0180655 | A1 | 7/2009 | Tien et al. | |
| 2010/0046780 | A1 | 2/2010 | Song | |
| 2010/0052082 | A1 | 3/2010 | Lee et al. | |
| 2010/0128914 | A1 | 5/2010 | Khenkin | |
| 2010/0183181 | A1 | 7/2010 | Wang | |
| 2010/0246877 | A1 | 9/2010 | Wang et al. | |
| 2010/0290644 | A1 | 11/2010 | Wu et al. | |
| 2010/0322443 | A1 | 12/2010 | Wu et al. | |
| 2010/0322451 | A1 | 12/2010 | Wu et al. | |
| 2011/0013787 | A1 | 1/2011 | Chang | |
| 2011/0075875 | A1 | 3/2011 | Wu et al. | |
| 2012/0033831 | A1* | 2/2012 | Leitner | H04R 1/083 381/98 |
| 2015/0110295 | A1* | 4/2015 | Jenkner | H04R 1/08 381/114 |
| 2015/0125003 | A1* | 5/2015 | Wiesbauer | B81B 3/0021 381/111 |

* cited by examiner $$S_{mic} \sim \frac{V_{bias}\Delta d}{\Delta Pd}$$

APPARATUS AND METHOD TO BIAS MEMS MOTORS

CROSS-REFERENCE TO RELATED APPLICATIONS

The present application claims priority to U.S. Provisional Application No. 62/289,611 "APPARATUS AND METHOD TO BIAS MEMS MOTORS" filed Feb. 1, 2016, the contents of which are incorporated by reference herein in their entirety.

TECHNICAL FIELD

This application relates to micro electro mechanical system (MEMS) devices and, more specifically, to electrically biasing these devices.

BACKGROUND

Different types of acoustic devices have been used through the years. One type of device is a microphone. In a microelectromechanical system (MEMS) microphone, a MEMS die includes at least one diagram and at least one back plate. The MEMS die is supported by a substrate and enclosed by a housing (e.g., a cup or cover with walls). A port may extend through the substrate (for a bottom port device) or through the top of the housing (for a top port device). In any case, sound energy traverses through the port, moves the diaphragm and creates a changing potential of the back plate, which creates an electrical signal. Microphones are deployed in various types of devices such as personal computers or cellular phones.

Microphone performance variation can occur due to wide process ranges or sensitivity to process parameters. Additionally, variations in operating environment can translate into different microphone performance requirements depending upon the amplitude and the frequency of the sound present. In previous approaches, there is little done to shape the response of the microphone and thereby address these situations.

The problems of previous approaches have resulted in some user dissatisfaction with these previous approaches.

SUMMARY

One aspect of the disclosure relates to a microphone comprising a first micro electro mechanical system (MEMS) motor and a second MEMS motor. The first MEMS motor includes a first diaphragm and a first back plate. The second MEMS motor includes a second diaphragm and a second back plate. The first diaphragm is electrically biased relative to the first back plate according to a first voltage, and the second diaphragm is electrically biased relative to the second back plate according to a second voltage. A magnitude of the first voltage is different from a magnitude of the second voltage.

Another aspect of the disclosure relates to microphone comprising a first micro electro mechanical system (MEMS) motor, a second MEMS motor, a third MEMS motor, and a fourth MEMS motor. The first MEMS motor includes a first diaphragm and a first back plate. The second MEMS motor includes a second diaphragm and a second back plate. The third MEMS motor includes a third diaphragm and a third back plate. The fourth MEMS motor includes a fourth diaphragm and a fourth back plate. The first diaphragm is electrically biased relative to the first back plate according to a first voltage, the second diaphragm is electrically biased relative to the second back plate according to a second voltage, the third diaphragm is electrically biased relative to the third back plate according to a third voltage, and the fourth diaphragm is electrically biased relative to the fourth back plate. At least two of magnitudes of the first voltage, the second voltage, the third voltage, and the fourth voltage are different.

Yet another aspect of the disclosure relates to a microphone comprising a micro electro mechanical system (MEMS) motor. The MEMS motor includes a diaphragm, a first back plate, and a second back plate. The diaphragm is formed with a tension caused by a film stress of the diaphragm. The diaphragm is electrically biased according to a voltage to adjust or compensate for the film stress.

The foregoing summary is illustrative only and is not intended to be in any way limiting. In addition to the illustrative aspects, embodiments, and features described above, further aspects, embodiments, and features will become apparent by reference to the following drawings and the detailed description.

BRIEF DESCRIPTION OF THE DRAWINGS

The foregoing and other features of the present disclosure will become more fully apparent from the following description and appended claims, taken in conjunction with the accompanying drawings. Understanding that these drawings depict only several embodiments in accordance with the disclosure and are, therefore, not to be considered limiting of its scope, the disclosure will be described with additional specificity and detail through use of the accompanying drawings.

Figure 1:
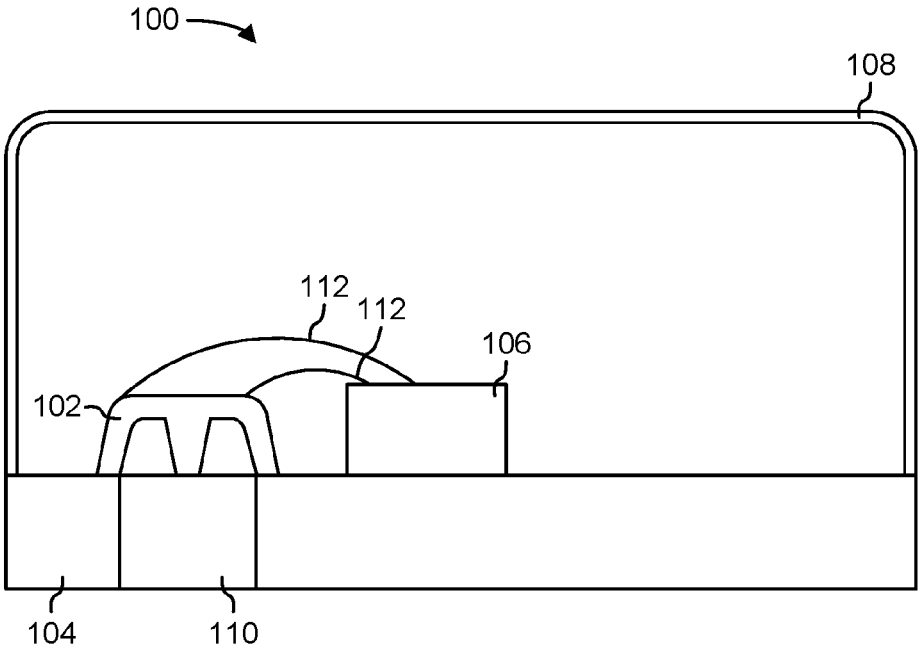
FIG. 1 is a side cut-away view of a microphone according to various embodiments.

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented here. It will be readily understood that the aspects of the present disclosure, as generally described herein, and illustrated in the figures, can be arranged, substituted, combined, and designed in a wide variety of different configurations, all of which are explicitly contemplated and make part of this disclosure.

DETAILED DESCRIPTION

The present approaches provide for application of different bias voltages for components (e.g., diaphragms) of micro electro mechanical system (MEMS) motors in microphones. The amount of bias (applied voltage to the diaphragm) controls the amount of acoustic signal that can be received and the amount of deflection of the diaphragms. Advantageously, the peak resonance response in the sensitivity response curve of the microphone is reduced. This lowers the total harmonic distortion (THD) and improves the performance of the microphone.

Referring now to FIG. 1, one example of a microphone 100 is described. The microphone 100 includes a MEMS device 102, a base 104 (e.g., a printed circuit board), an integrated circuit 106 (e.g., an application specific integrated circuit (ASIC)), a cover 108, and a port 110 that extends through the base 104. Although the port 110 extends through the base in this example (making this a bottom port device), it will be appreciated that the port 110 can extend through the cover (making the device a top port device).

The MEMS device 102 includes a diaphragm and a back plate. As sound pressure moves the diaphragm, a varying electrical potential with the back plate creates an electrical signal, which is sent to the integrated circuit 106 via wires 112. The integrated circuit 106 can perform further processing (e.g., noise removal) on the signal. The processed signal can then be sent from the integrated circuit 106 to the base 104. Pads (not shown) on the base 104 may be coupled to external electronic devices residing in the device where the microphone 100 is disposed. The microphone 100 may be disposed in a variety of different electronic devices such as cellular phones, lap tops, personal computers, tablets, and personal digital assistants to mention a few examples. Other examples are possible.

The MEMS device 102 includes multiple MEMS motors. In one aspect, each MEMS motor includes a diaphragm and a back plate. In one example, two MEMS motors may be present. In another examples, four MEMS motors may be present. Other examples are possible.

As described herein, the voltage bias applied to each of the diaphragms of the MEMS motors of the MEMS device 102 is different. Advantageously, the peak resonance response in the sensitivity response curve of the microphone 100 is thereby reduced. This lowers the total harmonic distortion (THD) and improves the performance of the microphone 100. Voltage may be applied to each of the back plates, but this voltage may be the same for each of the MEMS motors.

Figure 2:
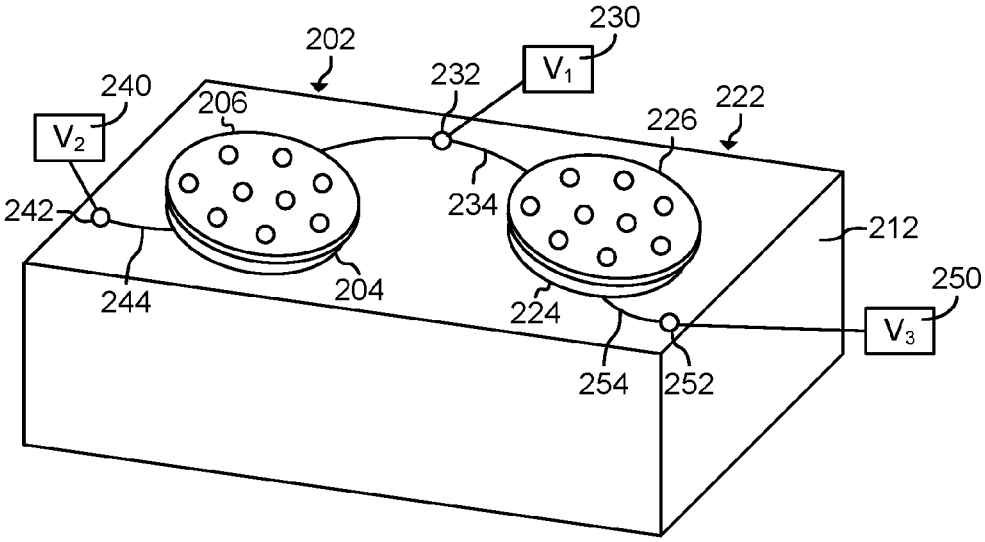
FIG. 2 is a perspective view of a micro electro mechanical system (MEMS) device according to various embodiments.
Figure 3:
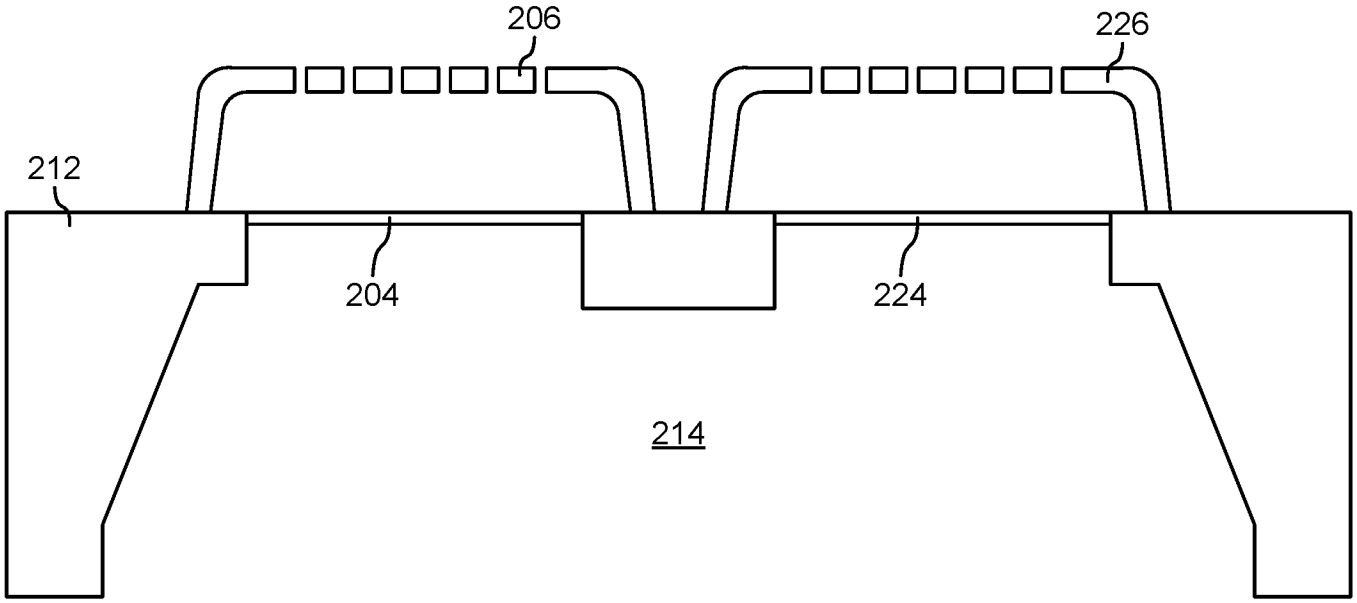
FIG. 3 is a cross-sectional view of the MEMS device of FIG. 2 according to various embodiments.

Referring now to FIG. 2 and FIG. 3, one example of biasing multiple MEMS motors is described.

A first MEMS motor 202 includes a first diaphragm 204 and a first back plate 206. A second MEMS motor 222 includes a second diaphragm 224 and a second back plate 226. The first diaphragm 204, first back plate 206, second diaphragm 224, and second back plate 226 couple to a MEMS substrate or base 212 that has a back hole 214.

A back plate bias voltage 230 is applied to back plates 206, 226 via a conductive pad 232 that couples to a conductive element (e.g., trace or wire) 234. The back plate bias voltage 230 is the same for each back plate 206 and 226. In one example, the back plate bias voltage is 0 volts. Other examples are possible. In one aspect, the back plate is connected to 0 VDC potential and is what is sensed, while the diaphragms 204 and 224 would have biases V1 and V2 separately. As used herein, a "sensed" electrode refers to an electrode from which the electric signal is received. In other configurations, the diaphragms 204 and 224 are connected to 0 VDC potential and two different biases V1 and V2 are applied on the back plates 206 and 226 separately. Both back plate and diaphragm wouldn't be biased by non-zero voltages at the same time. In some embodiments, the back plates 206 and 226 could be shorted together as shown in FIG. 2 creating one connection (or input) to an amplifier or could connect directly for instance to either a summing or differential amplifier as separate inputs.

In some embodiments, a first diaphragm bias voltage 240 is applied to the first diaphragm 204 via a first diaphragm connector 242 and first diaphragm conductive element (e.g., trace or wire) 244. A second diaphragm bias voltage 250 is applied to the second diaphragm 224 via a second diaphragm connector 252 and second diaphragm conductive element (e.g., trace or wire) 254. The first diaphragm bias voltage 240 and the second diaphragm bias voltage 250 are different. For example, the first diaphragm bias voltage 240 may be 10 volts and the second diaphragm bias voltage 250 may be 15 volts. Other examples are possible. It will be appreciated that the examples shown here are single motor configurations, they would also apply to multi-motor and/or stacked configurations.

The voltages 230, 240, and 250 that are used for biasing may be fixed or dynamically changed. In some embodiments, only the voltages on the non-sensed electrodes would be changed. For example, the voltages 240 and 250 may be dynamic and be changed. The voltages may be changed to adjust the corner frequency of the operation of the microphone.

Figure 4A:
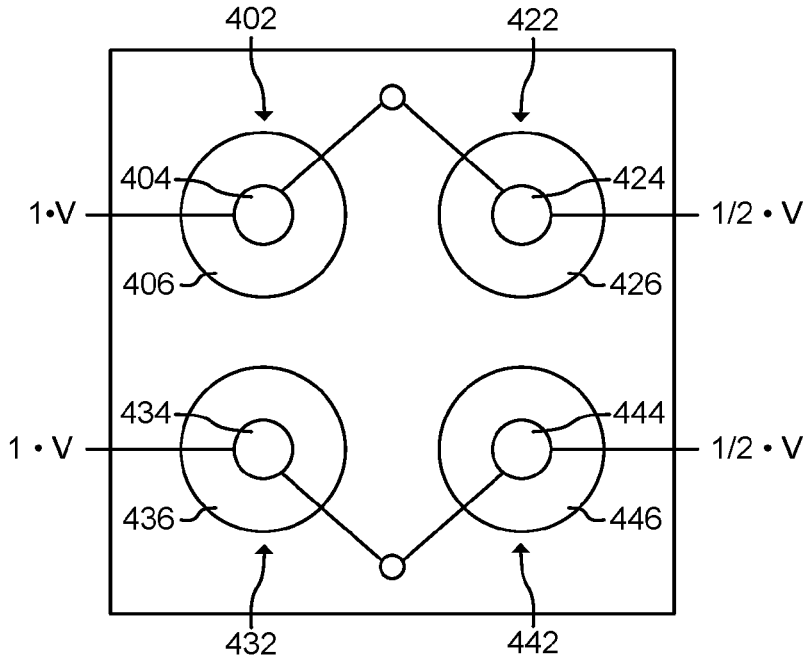
FIG. 4A is a block diagram showing four MEMS motors biased in one arrangement according to various embodiments.
Figure 4B:
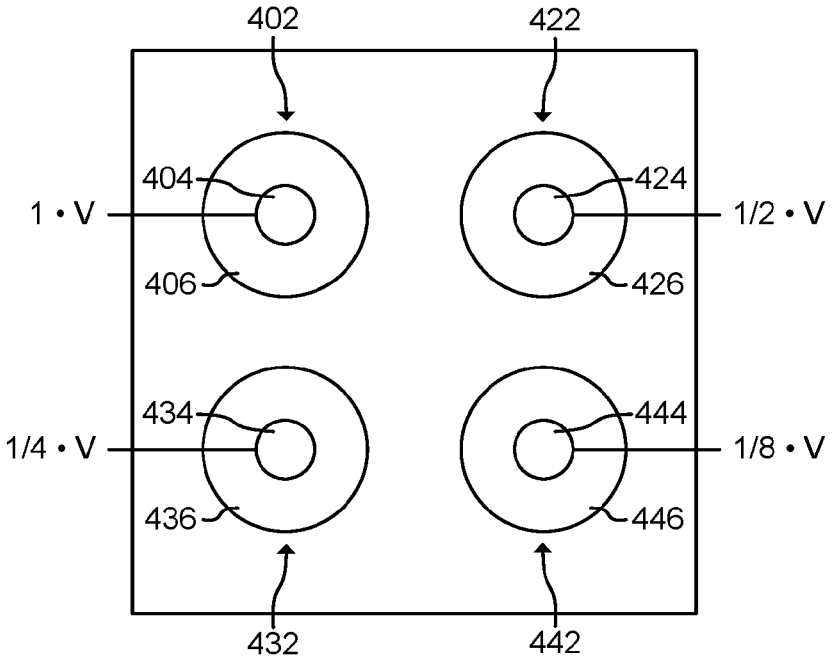
FIG. 4B is a block diagram showing four MEMS motors biased in another arrangement according to various embodiments.

Referring now to FIG. 4A and FIG. 4B, another example of biasing multiple MEMS motors is described. A first MEMS motor 402 includes a first diaphragm 404 and a first back plate 406. A second MEMS motor 422 includes a second diaphragm 424 and a second back plate 426. A third MEMS motor 432 includes a third diaphragm 434 and a third back plate 436. A fourth MEMS motor 442 includes a fourth diaphragm 444 and a fourth back plate 446.

In the examples of FIGS. 4A and 4B, the back plates 406, 426, 436, and 446 are biased with the same voltage (e.g., 0 volts). This voltage is different from any of the biases applied to any of the diaphragms 404, 424, 434, and 444.

In the example of FIG. 4A, the first diaphragm 404 is based at 1·V, the second diaphragm 424 is biased at ½·V, the third diaphragm 434 biased at 1·V, and the fourth diaphragm 444 biased at ½·V. Thus, motor pairs 402, 422 are biased at the same voltage as motor pair 432, 442.

It will be appreciated that the bias voltages given in FIG. 4A and FIG. 4B are examples only and that other examples are possible.

In the example of FIG. 4A, the first diaphragm 404 is based at 1·V, the second diaphragm 424 is biased at ½·V, the third diaphragm 434 biased at ¼·V, and the fourth diaphragm 444 biased at ⅛·V. Thus, motor pairs 402, 422, 432, and 442 are all biased at different voltages.

In some embodiments, the example of FIG. 4B misaligns all of the diaphragm resonances since all of the voltages are different, but it would also be less sensitive. The example of FIG. 4A is more sensitive, but some of the resonances would align.

Figure 5:
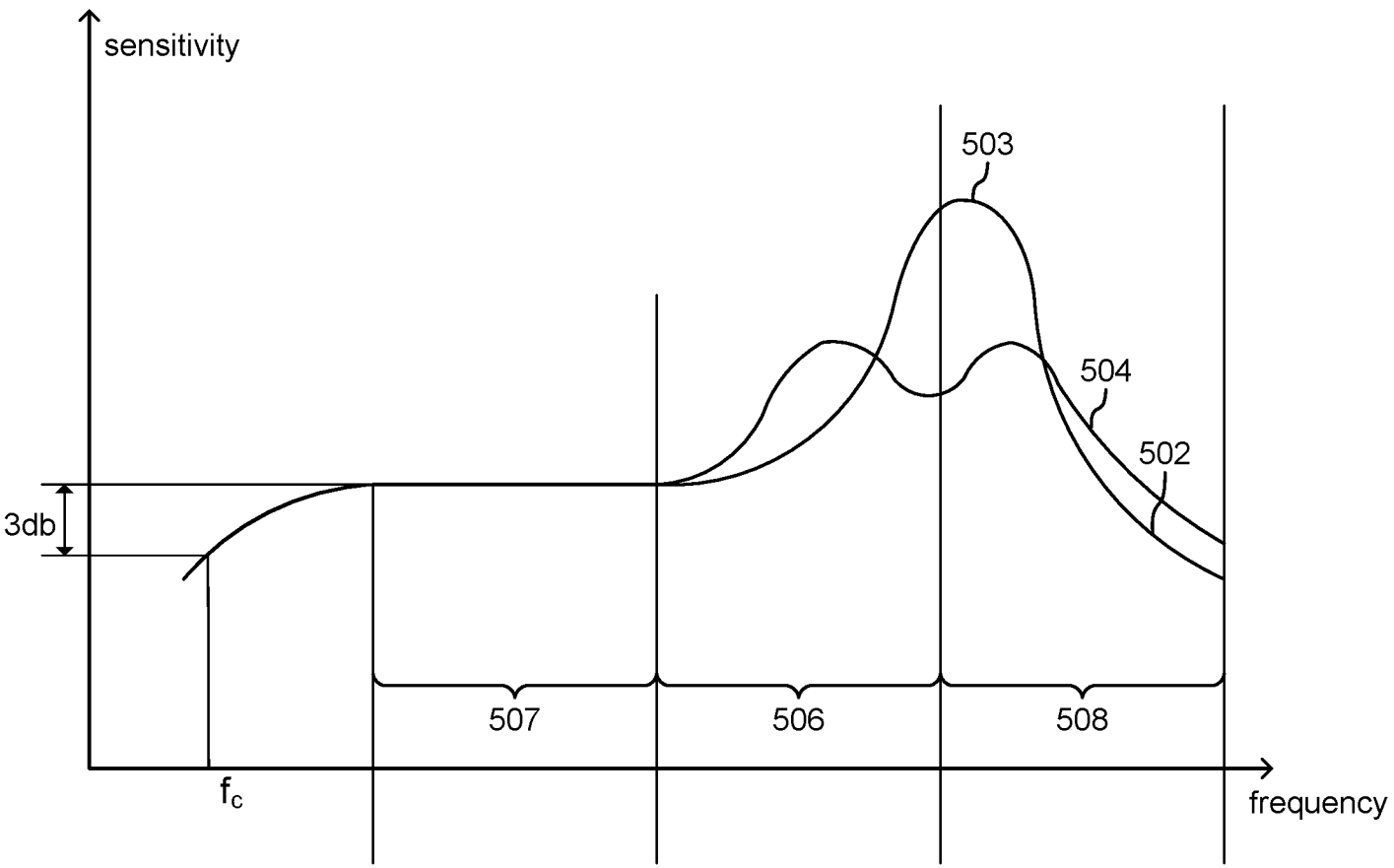
FIG. 5 is a graph showing sensitivity versus frequency and some of the advantages according to various embodiments.

Referring now to FIG. 5, one example of a graph showing some of the advantages of the present approaches is described. This shows results with a first MEMS motor (that includes a first diaphragm and a first back plate) and a second MEMS motor (that includes a second diaphragm and a second back plate).

A first curve 502 shows sensitivity (measured in dB) versus frequency (measured in Hz) when both diaphragms are biased at the same potential. It can be seen that there is a large peak 503. This large peak 503 is not good or desirable for performance because it can overload the microphone circuit or other electronics downstream.

A second curve 504 shows sensitivity (measured in dB) versus frequency (measured in Hz) when the diaphragms are biased at different potentials. In one aspect, the first diaphragm may be biased at 10 volts and the second diaphragm may be biased at 20 volts. The peak is split in two. This is advantageous because the energy of the transducer is not focused in a narrow region, which prevents overload.

It can be seen that sensitivity can be controlled in regions 506 and 508 of the sensitivity curve 504. The exact amount of sensitivity provided may in part depend upon the amount of bias applied to each of the diaphragms and the difference between the biases applied. As can be seen, if region 508 is a region of ultrasonic sensitivity, the sensitivity in that region is reduced by application of the present approaches.

It will also be appreciated that the present approaches can be used to vary the corner frequency (fc) of curve 504. The corner frequency fc is the frequency where a 3 db drop occurs from the constant portion 507 of the curve 504. The corner frequency fc may be varied during manufacturing to bring it into compliance with a product specification. The corner frequency fc may also be varied in the field after manufacturing when wind noise is an overloading input to prevent clipping and distortion. The corner frequency may be also varied in the field after manufacturing to move it down for customer algorithms that require a constant phase and/or high signal-to-noise ratios at low frequencies.

When a vent hole (also known as a pierce hole) is used, the proximity of the hole in the diaphragm to the back plate affects the acoustic resistance of the microphone. Varying the bias affects the diaphragm position and consequently varying the bias varies the corner frequency.

Figures 6A, 6B:
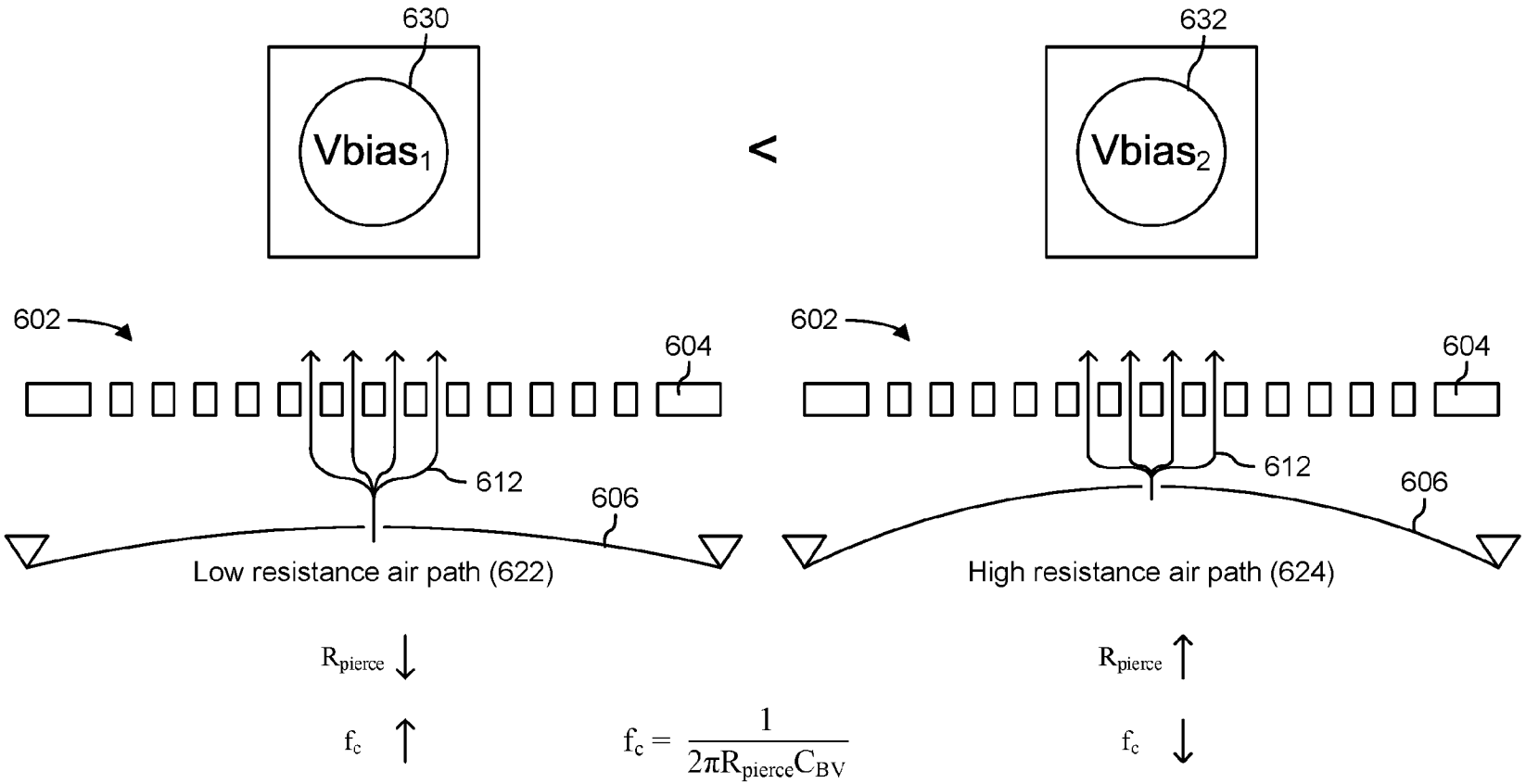
FIG. 6A is a diagram showing how to adjust the corner frequency of the sensitivity response according to various embodiments.
FIG. 6B is a diagram showing another example how to adjust the corner frequency of the sensitivity response according to various embodiments.

FIGS. 6A and 6B show a MEMS motor 602 with a back plate 604 and a diaphragm 606. The bias applied to the diaphragm (that has a vent or pierce hole 612) is variable and adjustable. The corner frequency (fc) is given by $$f_c = \frac{1}{2\pi R_{pierce} C_{BV}},$$

where $R_{pierce}$ is the acoustic resistance of the vent or pierce hole and CBV is the acoustic compliance of the back volume.

Referring now to FIG. 6A, a smaller bias (Vbias(1)) (e.g., Vbias(1)=5 volts) makes the diaphragm 606 deflect less and increases the corner frequency cf(1) because a low resistance air path 622 is provided (the diaphragm and back plate are relatively far apart).

Referring now to FIG. 6B, a larger bias (Vbias(2) with Vbias(2)>Vbias(1), e.g., Vbias(2)=20 volts) makes the diaphragm 606 deflect more and decreases the corner frequency cf(2) because a high resistance air path 624 is provided (the diaphragm and back plate are relatively close together). Cf(2) is less than cf(1).

Figure 7:
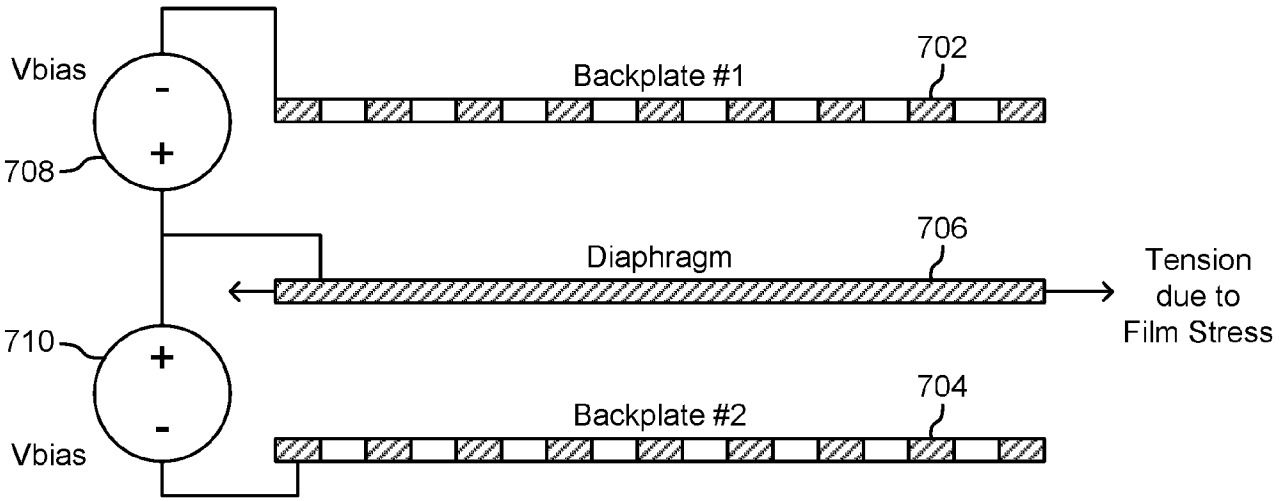
FIG. 7 is a side cut-away view of another example of a MEMS device according to various embodiments.

Referring now to FIG. 7, another example of a MEMS device 700 is described. The MEMS device 700 includes a first back plate 702, a second back plate 704, and a diaphragm 706 disposed between the first back plate 702 and the second back plate 704. A first Vbias 708 is applied between the first back plate 702 and the diaphragm 706, and a second Vbias 710 is applied between the second back plate 704 and the diaphragm 706. In one example, the first Vbias 708 and the second Vbias 710 are the same. The diaphragm 706 in one example is a membrane or film that is formed with a film stress.

Film stress induces tension on the diaphragm 706. Increased tension due to the increased film stress results in less deflection of the diaphragm (Δd) for the same sound pressure (ΔP). During manufacturing, the stress can vary substantially. To combat changes in tension due to film stress, the bias can be dynamically changed during or after manufacturing to adjust the sensitivity:

Sensitivity is proportional to $$\frac{V_{bias} \cdot \Delta d}{\Delta P \cdot d},$$

where $V_{bias}$ is the voltage applied to the diaphragm, Δd is the deflection of the diaphragm, ΔP is the change in sound pressure and d is the nominal gap.

To take one example, if a change in pressure (ΔP) causes a change in deflection (Δd), then Vbias can be adjusted up or down to maintain the same sensitivity or to maintain a target sensitivity. As mentioned, this adjustment may occur on the fly during or after manufacturing of the microphone.

The herein described subject matter sometimes illustrates different components contained within, or connected with, different other components. It is to be understood that such depicted architectures are merely exemplary, and that in fact many other architectures can be implemented which achieve the same functionality.

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.).

It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to inventions containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations).

The foregoing description of illustrative embodiments has been presented for purposes of illustration and of description. It is not intended to be exhaustive or limiting with respect to the precise form disclosed, and modifications and variations are possible in light of the above teachings or may be acquired from practice of the disclosed embodiments. It is intended that the scope of the invention be defined by the claims appended hereto and their equivalents.

What is claimed is:

1. A microphone, comprising:

a first micro electro mechanical system (MEMS) motor, the first MEMS motor including a first diaphragm and a first back plate; and a second MEMS motor including a second diaphragm and a second back plate;

wherein the first diaphragm is electrically biased relative to the first back plate according to a first voltage, the second diaphragm is electrically biased relative to the second back plate according to a second voltage, and a magnitude of the first voltage is different from a magnitude of the second voltage; and wherein the microphone is configured to vary a corner frequency of a response curve of the microphone, the microphone varying the corner frequency by dynamically adjusting the first voltage and the second voltage.

2. The microphone of claim 1, wherein the first voltage and the second voltage are dynamically adjustable during manufacturing of the microphone.

3. The microphone of claim 1, wherein the first voltage and the second voltage are dynamically adjustable during operation of the microphone.

4. The microphone of claim 1, wherein a back plate bias voltage is applied to the first back plate and the second back plate, a first diaphragm bias voltage is applied to the first diaphragm, a second diaphragm bias voltage is applied to the second diaphragm, and the first diaphragm bias voltage is different from the second diaphragm bias voltage.

5. The microphone of claim 4, wherein the first back plate and the second back plate are connected to an amplifier as one input.

6. The microphone of claim 4, wherein the first back plate and the second back plate are connected to a summing amplifier as separate inputs.

7. The microphone of claim 4, wherein the first back plate and the second back plate are connected to a differential amplifier as separate inputs.

8. The microphone of claim 1, wherein the microphone is further configured to vary a resonant frequency of a response curve of the microphone by dynamically adjusting the first voltage and the second voltage.

9. The microphone of claim 1, wherein a first pierce hole pierces the first diaphragm and a second pierce hole pierces the second diaphragm.

10. The microphone of claim 9, wherein an acoustic resistance is associated with each of the first pierce hole and the second pierce hole.

11. The microphone of claim 9, wherein the acoustic resistance of the first pierce hole and the acoustic resistance of the second pierce hole are inversely proportional to the corner frequency of the response curve of the microphone.

12. The microphone of claim 9, wherein the first diaphragm and the first back plate form a first air path with a first resistance, the second diaphragm and the second back plate form a second air path with a second resistance, and the first resistance is different from the second resistance.

13. A microphone, comprising:

a first micro electro mechanical system (MEMS) motor, the first MEMS motor including a first diaphragm and a first back plate;

a second MEMS motor including a second diaphragm and a second back plate;

third MEMS motor including a third diaphragm and a third back plate; and a fourth MEMS motor including a fourth diaphragm and a fourth back plate, wherein the first diaphragm is electrically biased relative to the first back plate according to a first voltage, the second diaphragm is electrically biased relative to the second back plate according to a second voltage, the third diaphragm is electrically biased relative to the third back plate according to a third voltage, the fourth diaphragm is electrically biased relative to the fourth back plate, and at least two of magnitudes of the first voltage, the second voltage, the third voltage, and the fourth voltage are different; and wherein the microphone is configured to vary a corner frequency of a response curve of the microphone, the microphone varying the corner frequency by dynamically adjusting the first voltage, the second voltage, the third voltage, and the fourth voltage.

14. The microphone of claim 13, wherein a magnitude of the first voltage is the same as a magnitude of the second voltage, a magnitude of the third voltage is the same as a magnitude of the fourth voltage, and the magnitude of the first voltage is different from the magnitude of the third voltage.

15. The microphone of claim 13, wherein a magnitude of the second voltage is ½ of a magnitude of the first voltage, a magnitude of the third voltage is ¼ of the magnitude of the first voltage, and a magnitude of the fourth voltage is ⅛ of the magnitude of the first voltage.

* * * * *